US010517447B2

(12) United States Patent
Nye

(10) Patent No.: US 10,517,447 B2
(45) Date of Patent: Dec. 31, 2019

(54) AUXILIARY TOILET SEAT ASSEMBLY

(71) Applicant: Scott Nye, Carson, CA (US)

(72) Inventor: Scott Nye, Carson, CA (US)

( * ) Notice: Subject to any disclaimer, the term of this patent is extended or adjusted under 35 U.S.C. 154(b) by 0 days.

(21) Appl. No.: 15/925,747

(22) Filed: Mar. 19, 2018

(65) Prior Publication Data

US 2019/0282042 A1 Sep. 19, 2019

(51) Int. Cl.

| | |
|---|---|
| ***A47K 11/04*** | (2006.01) |
| ***A47K 11/06*** | (2006.01) |
| ***A47K 17/02*** | (2006.01) |
| ***A47K 13/02*** | (2006.01) |

(52) U.S. Cl.

CPC ..... *A47K 11/04* (2013.01); *A47K 11/06* (2013.01); *A47K 13/02* (2013.01); *A47K 17/026* (2013.01)

(58) Field of Classification Search

CPC ..... A47K 11/04; A47K 11/06; A47K 13/02

USPC ..... 4/483, 480

See application file for complete search history.

(56) References Cited

U.S. PATENT DOCUMENTS

| | | | | |
|---|---|---|---|---|
| D179,394 | S | 12/1956 | Mills | |
| 3,271,785 | A * | 9/1966 | Du Bose | A61G 5/1002 297/118 |
| 4,550,455 | A * | 11/1985 | Carson | A41D 13/1254 297/352 |
| 4,587,678 | A | 5/1986 | Love | |
| 4,823,412 | A | 4/1989 | Spiegel | |
| 6,745,410 | B2 * | 6/2004 | Ford | A47K 11/04 4/483 |
| 6,941,591 | B2 | 9/2005 | Battiston | |
| 2005/0022294 | A1 | 2/2005 | Laguera Garza et al. | |
| 2006/0042005 | A1 | 3/2006 | Johnson | |
| 2006/0207002 | A1 | 9/2006 | Bradshaw | |
| 2008/0000019 | A1 * | 1/2008 | Marinas | A61G 5/1002 4/480 |
| 2009/0313753 | A1 | 12/2009 | Campbell | |
| 2017/0000303 | A1 * | 1/2017 | Cheng | E03D 9/05 |

* cited by examiner

*Primary Examiner* — Huyen D Le

(57) ABSTRACT

An auxiliary toilet seat assembly for assisting an obese individual with urinating and defecating into a toilet includes a chair that is selectively positioned over a toilet. The chair is selectively mounted thereby facilitating urination and defecation into the toilet. The chair has a weight capacity of at least 130.0 kg to support an obese user. The chair has an aperture extending therethrough to pass urination and defecation therethrough and into the toilet. A cushion is coupled to the chair for enhancing comfort of the chair. A pan is slidably coupled to the chair to capture the urination and defecation.

10 Claims, 8 Drawing Sheets

AUXILIARY TOILET SEAT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to toilet devices and more particularly pertains to a new toilet device for assisting an obese user with urinating and defecating into a toilet.

BRIEF SUMMARY OF THE INVENTION

An embodiment of the disclosure meets the needs presented above by generally comprising a chair that is selectively positioned over a toilet. The chair is selectively mounted thereby facilitating urination and defecation into the toilet. The chair has a weight capacity of at least 130.0 kg to support an obese user. The chair has an aperture extending therethrough to pass urination and defecation therethrough and into the toilet. A cushion is coupled to the chair for enhancing comfort of the chair. A pan is slidably coupled to the chair to capture the urination and defecation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
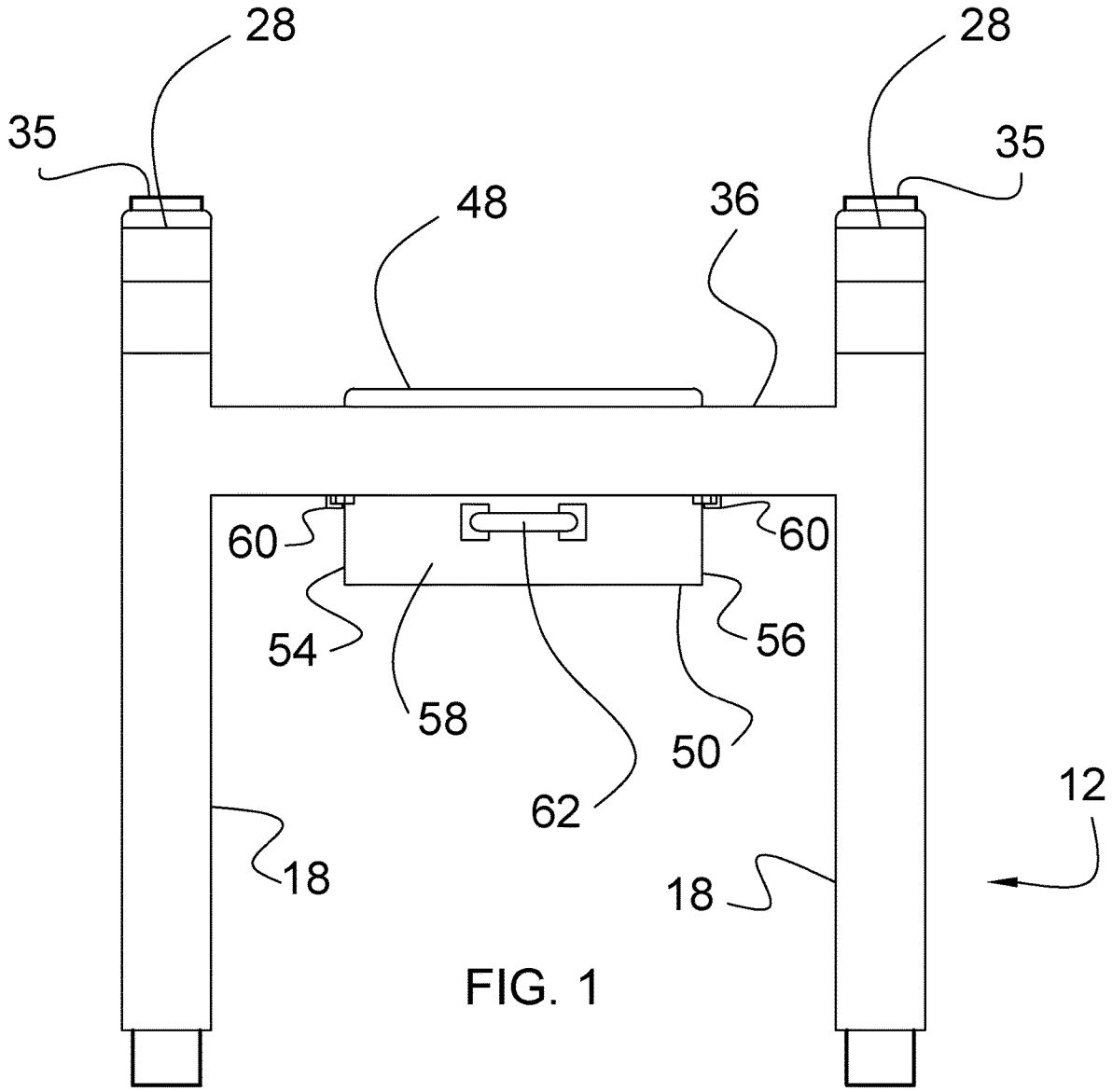
FIG. 1 is a front view of an auxiliary toilet seat assembly according to an embodiment of the disclosure.
Figure 2:
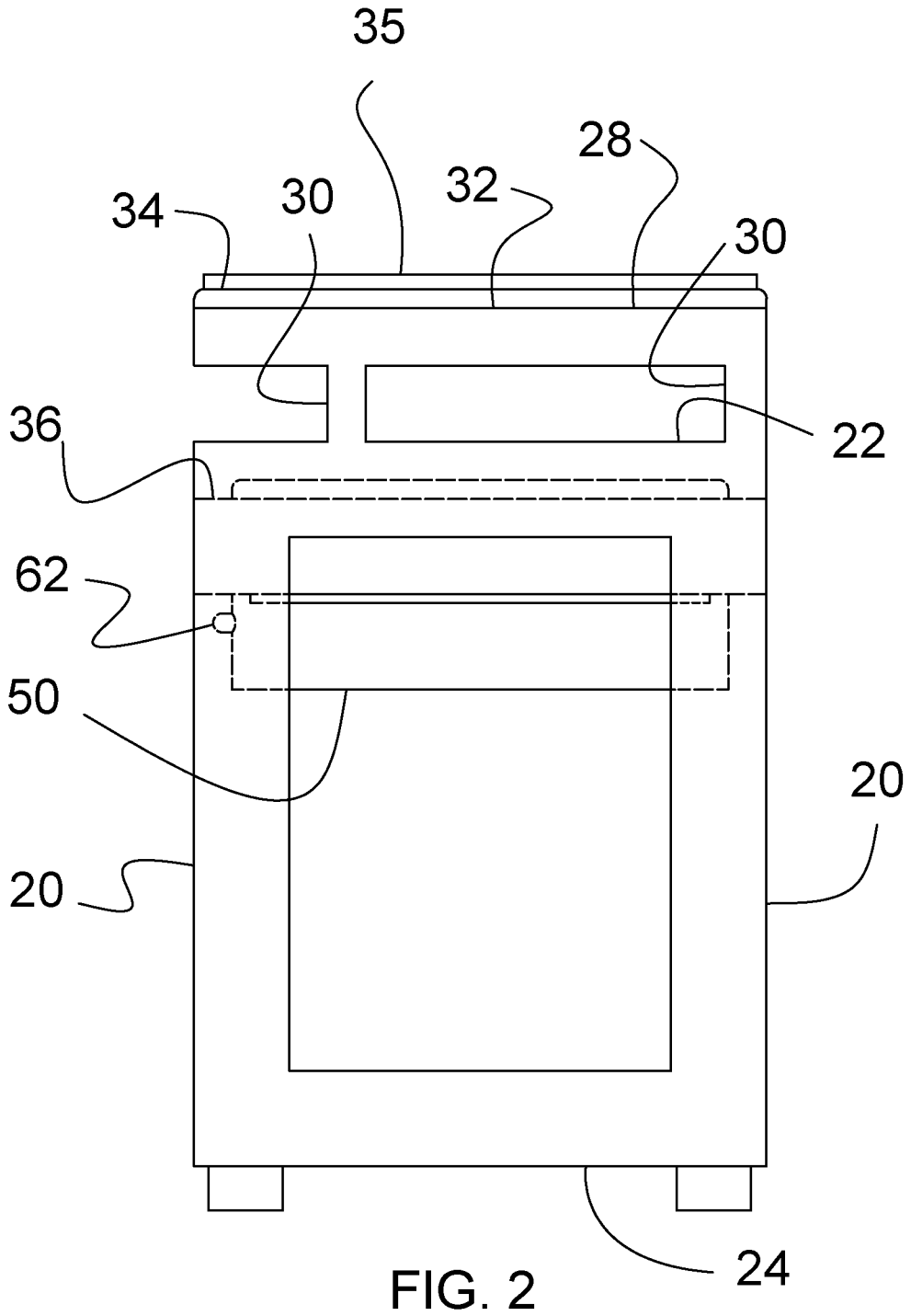
FIG. 2 is a left side perspective view of an embodiment of the disclosure.
Figure 3:
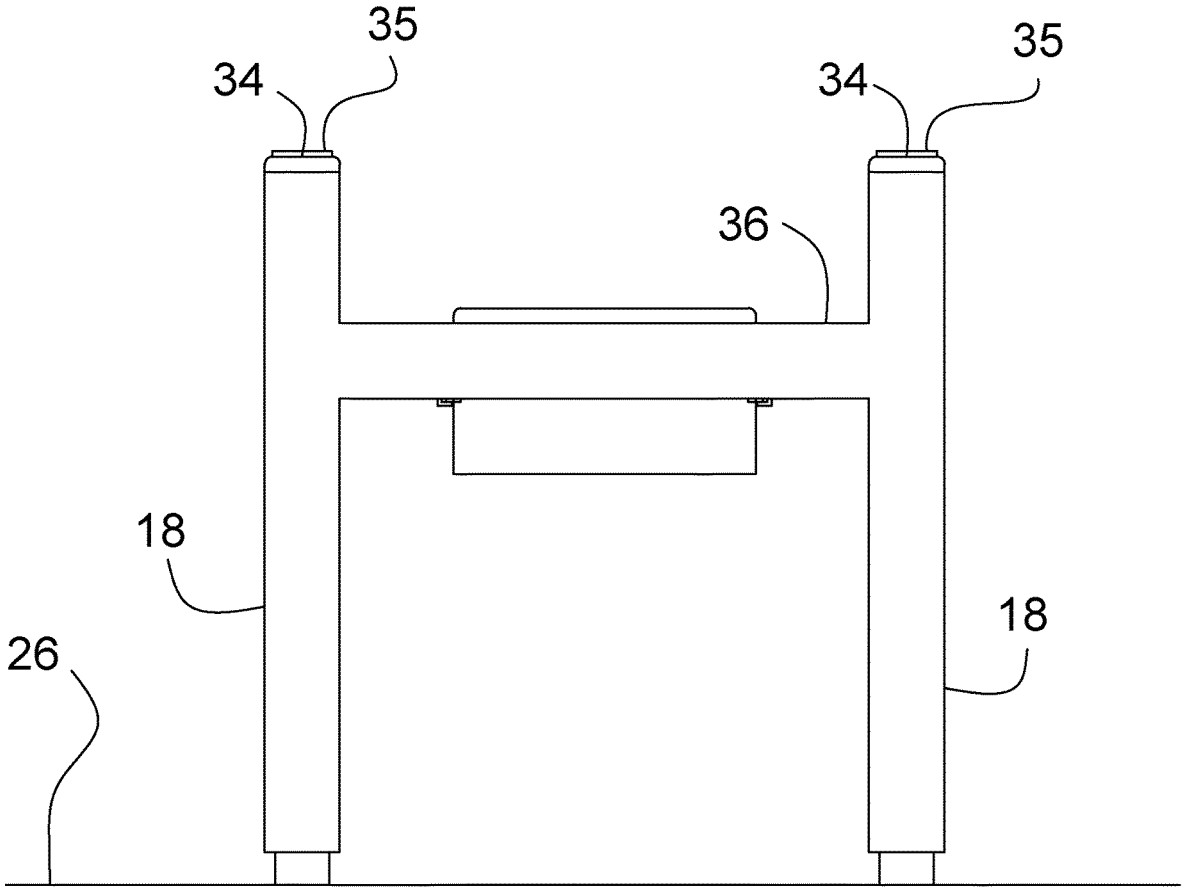
FIG. 3 is a back view of an embodiment of the disclosure.
Figure 4:
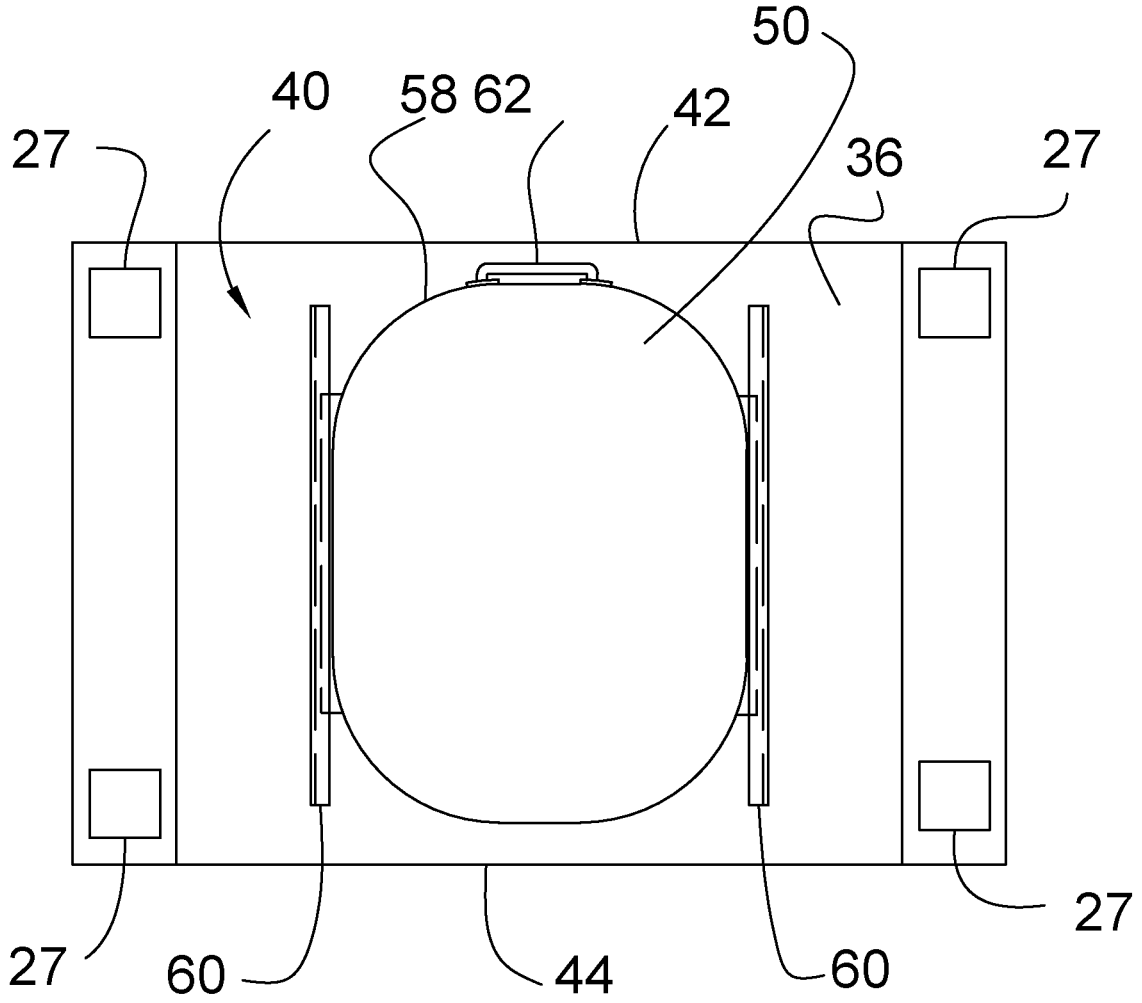
FIG. 4 is a bottom phantom view of an embodiment of the disclosure.
Figure 5:
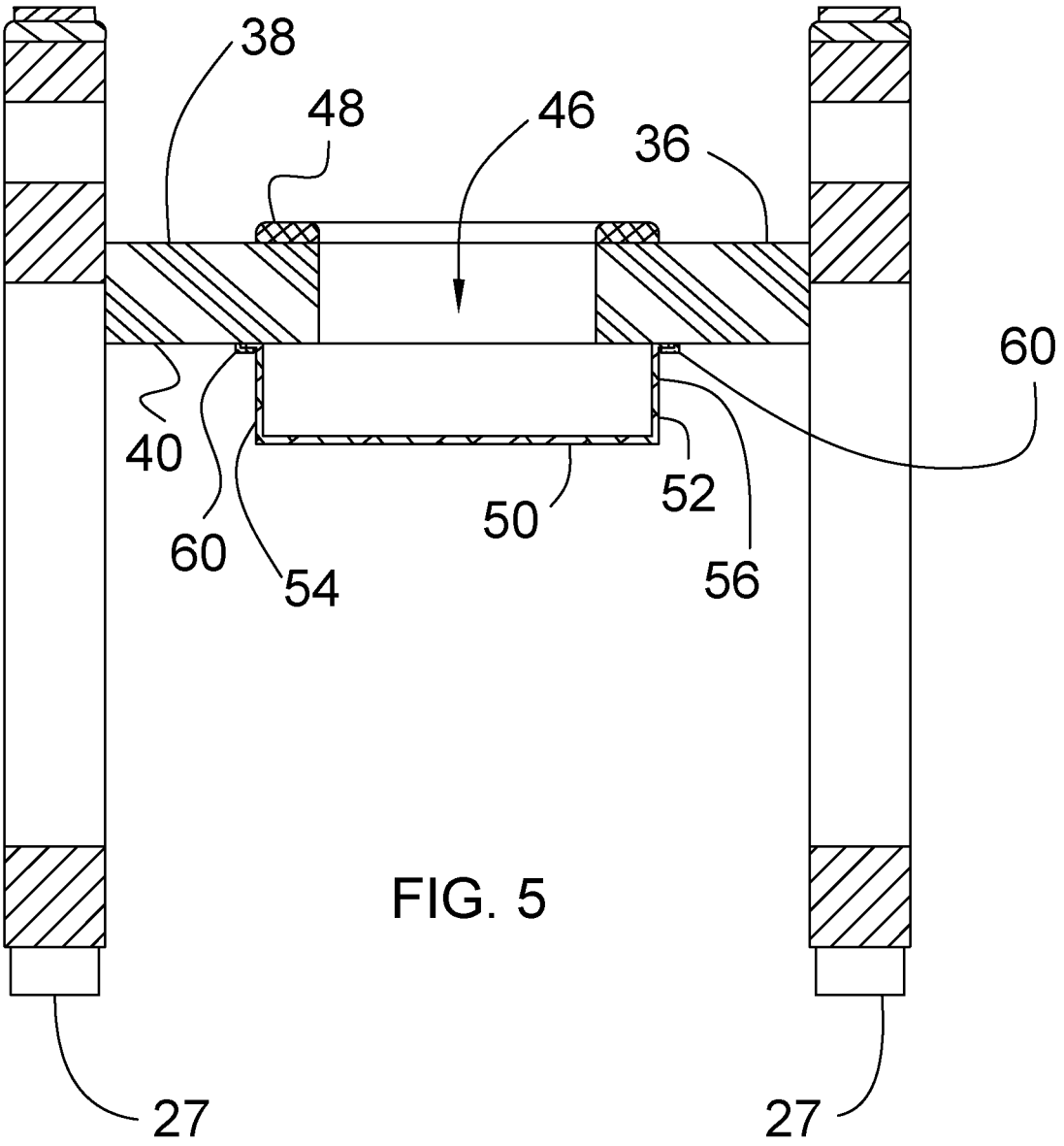
FIG. 5 is a cross sectional view taken along line 5-5 of FIG. 8 of an embodiment of the disclosure.
Figure 6:
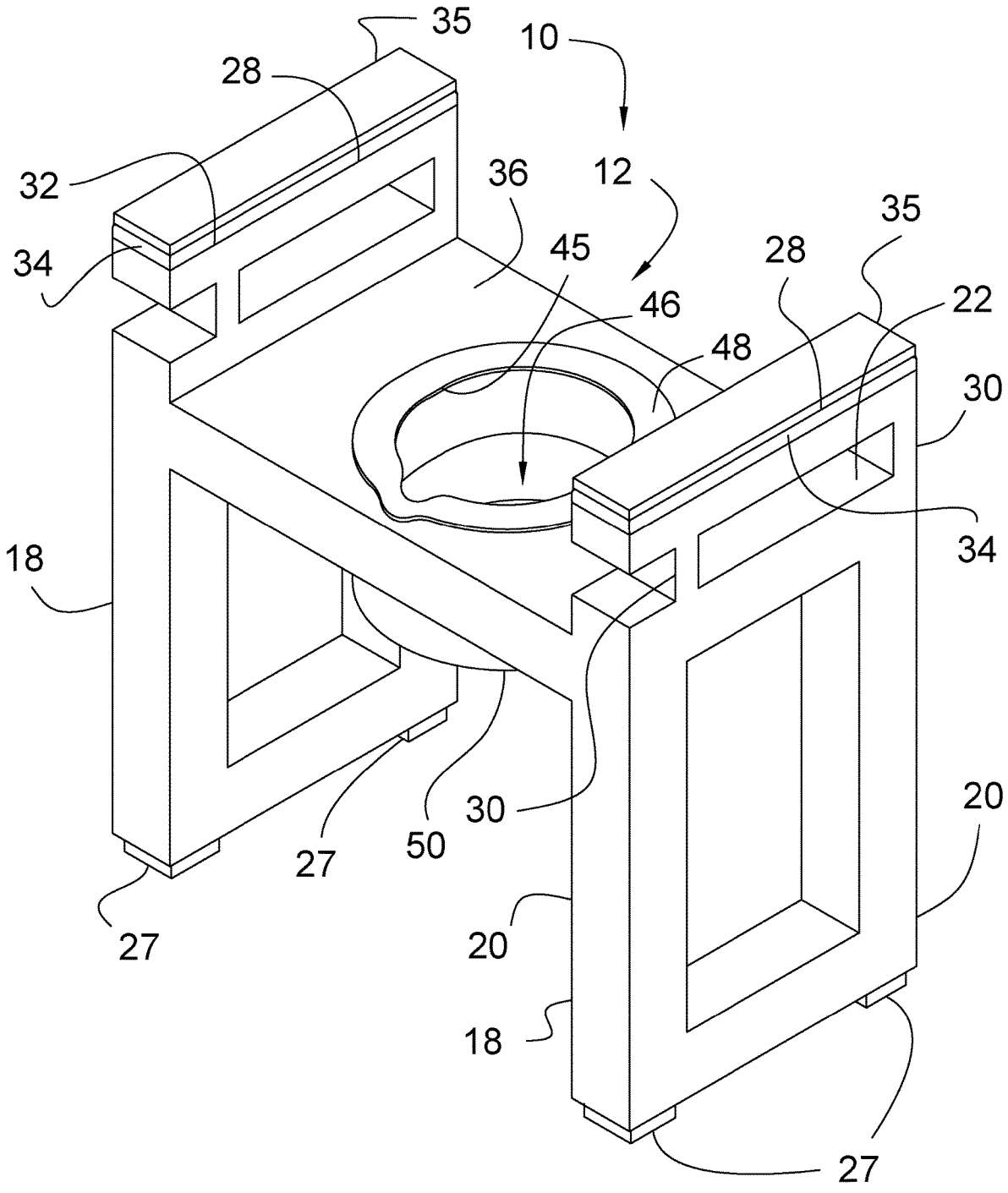
FIG. 6 is a perspective view of an embodiment of the disclosure.
Figure 7:
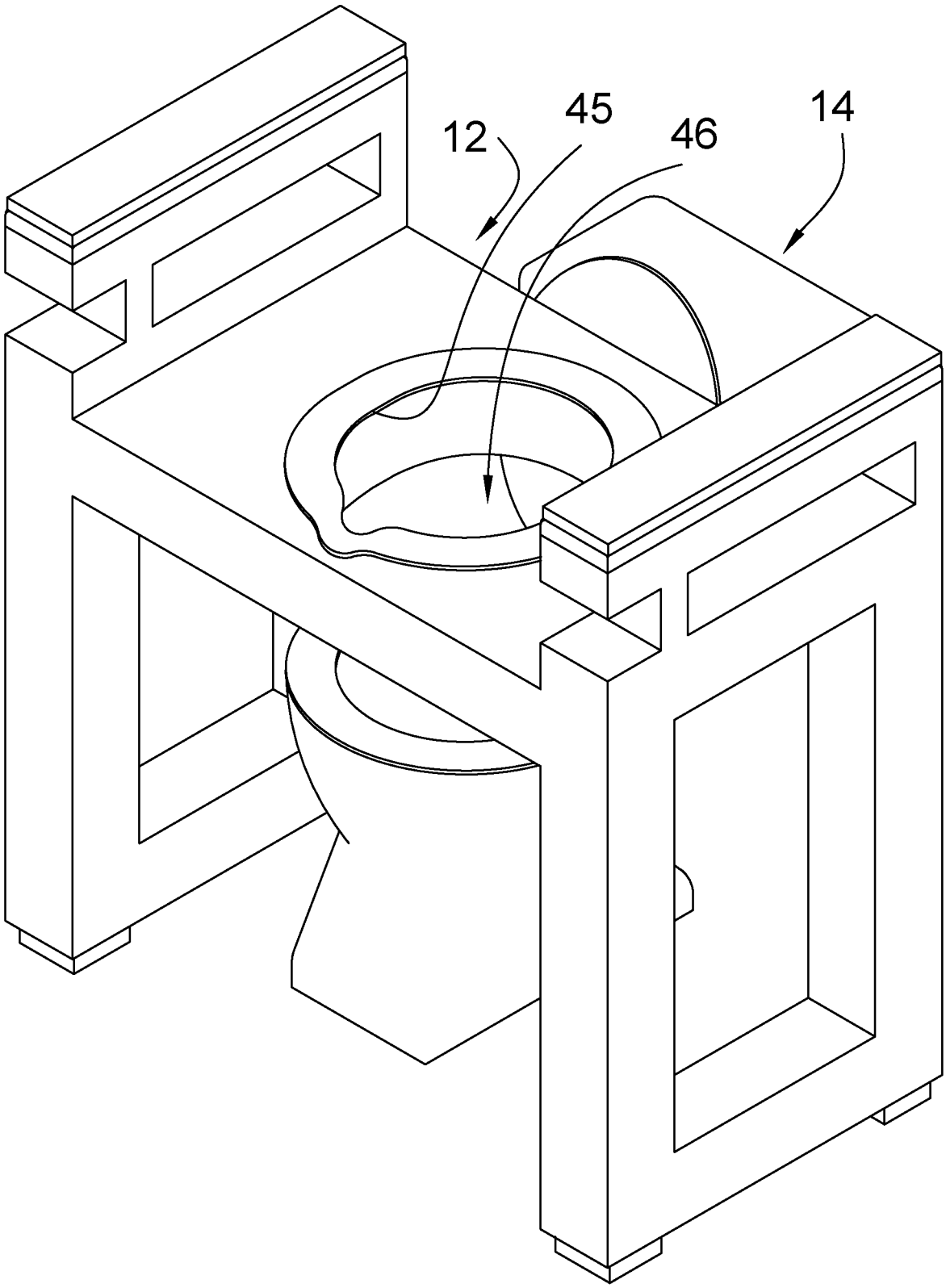
FIG. 7 is a perspective in-use view of an embodiment of the disclosure.
Figure 8:
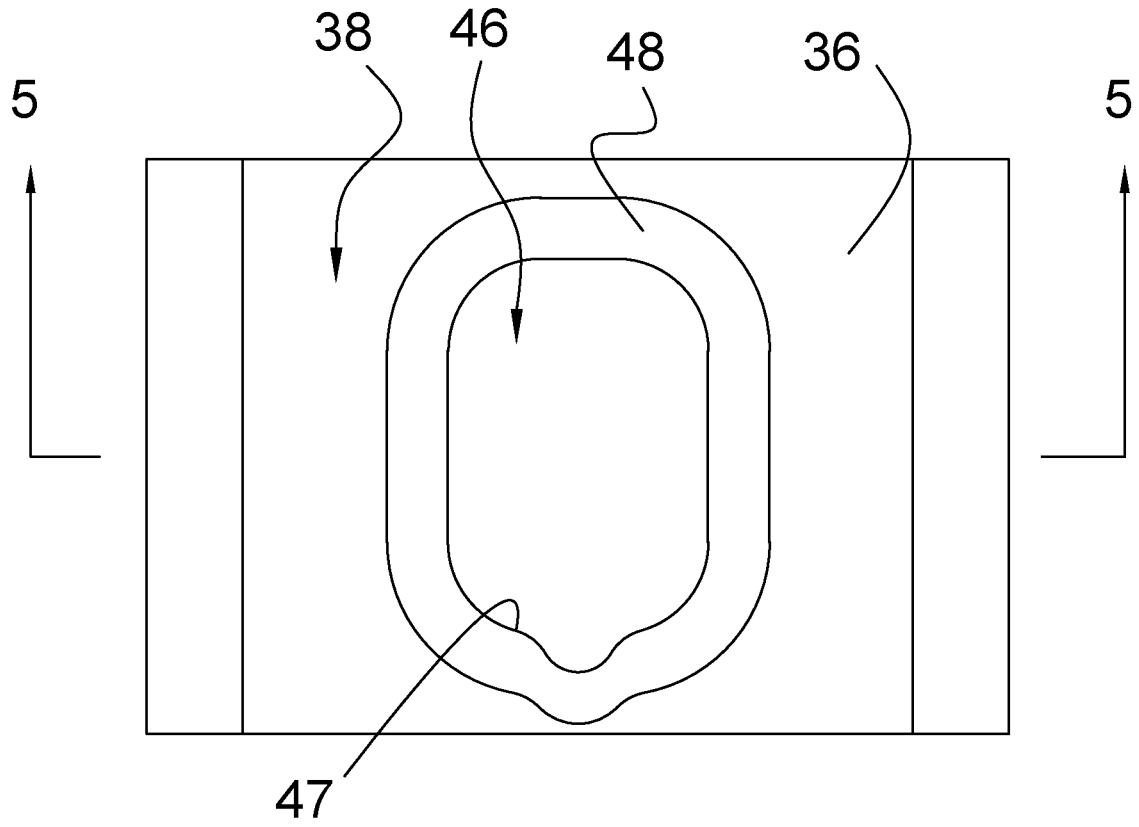
FIG. 8 is a top view of an embodiment of the disclosure.

With reference now to the drawings, and in particular to FIGS. 1 through 8 thereof, a new toilet device embodying the principles and concepts of an embodiment of the disclosure and generally designated by the reference numeral 10 will be described.

As best illustrated in FIGS. 1 through 8, the auxiliary toilet seat assembly 10 generally comprises a chair 12 that is selectively positioned over a toilet 14. The chair 12 is mounted thereby facilitating urination and defecation into the toilet 14. Moreover, the chair 12 has a weight capacity of greater than 130.0 kg to support an obese user. In this way the chair 12 facilitates the obese user to urinate and defecate into a toilet 14 that would otherwise be difficult or impossible for the user to mount. The chair 12 has an aperture 16 extending therethrough to pass urination and defecation therethrough.

The chair 12 comprises a pair of uprights 18 and each of the uprights 18 has a pair of first members 20 each extending between a top member 22 and a bottom member 24. The first members 20 corresponding to each of the uprights 18 is spaced apart from each other such that each of the uprights 18 has a rectangular shape. The bottom member 24 corresponding to each of the uprights 18 is positioned on a support surface 26 such that the top member 22 corresponding to each of the uprights 18 is spaced from the support surface 26. Each of the uprights 18 may have a height ranging between approximately 60.0 cm and 90.0 cm. A plurality of feet 27 is provided and each of the feet 27 is coupled to the bottom member 24 of an associated one of the uprights 18. Each of the feet 27 abuts the support surface 26 and each of the feet 27 is comprised of a friction enhancing material, such as rubber or the like. Thus, each of the feet 27 frictionally engages the support surface 26 thereby inhibiting the chair 12 from sliding on the support surface 26.

A pair of armrests 28 is provided and each of the armrests 28 is coupled to the top member 22 of an associated one of the uprights 18. Each of the armrests 28 includes a pair of feet 30 that extend between the armrests 28 and the associated top member 22 such that each of the armrests 28 is spaced from the associated top member 22. Each of the armrests 28 has a top surface 32 and a pair of pads 34 is each coupled to the top surface 32 of an associated one of the armrests 28. Each of the pads 34 is comprised of a resiliently compressible material to enhance comfort of the armrests 28. A pair of gel strips 35 may be provided and each of the gel strips 35 may be coupled to an associated one of the pads 34 to further enhance comfort of the armrests 28.

The chair 12 includes a seat 36 that has a top surface 38, a bottom surface 40, a front side 42 and a back side 44. The seat 36 is coupled between each of the uprights 18 having the top surface 38 and some bottom surface 40 being horizontally oriented. Thus, the seat 36 supports the obese user when the user mounts the chair 12. The seat 36 is positioned closer to the top member 22 than the bottom member 24 of the uprights 18. Moreover, the seat 36 may be spaced a minimum distance of 55.0 cm from the bottom member 24 of the uprights 18. In this way the seat 36 spaced above the toilet 14 when the chair 12 is positioned around the toilet 14.

The seat 36 has an opening 46 extending through the top surface 38 and the bottom surface 40 to pass urination and defecation therethrough when the user sits on the seat 36. The opening 46 has a bounding edge 45 and the bounding edge 45 may extend toward the front side 42 of the seat 36 to accommodate male users. A cushion 48 is coupled to the chair 12 and the cushion 48 is sat upon thereby enhancing comfort of the chair 12. The cushion 48 is positioned on the top surface 32 of the seat 36 and the cushion 48 is continuous such that the cushion 48 forms a closed loop surrounding the opening 46 in the seat 36. Additionally, the cushion 48 is coextensive with the bounding edge 45 of the opening 46 for accommodating male users. Each of the uprights 18 and the seat 36 may have a thickness of approximately 12.0 cm and each of the uprights 18 and seat 36 may be constructed of plastic.

A pan 50 is slidably coupled to the chair 12 to capture the urination and defecation. The pan 50 has an outer wall 52 and the outer wall 52 has a first lateral side 54, a second lateral side 56 and a front side 58. A pair of tracks 60 is provided and each of the tracks 60 is coupled to the bottom surface 40 of the seat 36. Each of the tracks 60 is positioned on opposite sides of the opening 46 with respect to each other and each of the tracks 60 extends between the front side 42 and the back side 44 of the seat 36. Each of the first lateral side 54 and the second lateral side 56 of the pan 50 slidably engages an associated one of the tracks 60. Thus, the pan 50 is selectively positioned in a first position having the pan 50 being positioned beneath the opening 46 for capturing the urination and defecation. The pan 50 is selectively positioned in a second position having the pan 50 being removed from the seat 36 for emptying the pan 50. A handle 62 is coupled to the front side 58 of the pan 50 for gripping the pan 50.

In use, the pan 50 is positioned in the second position, having the pan 50 being removed from the tracks 60, and the chair 12 is positioned over the toilet 14. The user mounts the chair 12 and the user urinates and defecates through the opening 46 in the seat 36. In this way the chair 12 supports the weight of the user while allowing the user's urination and defecation to be captured by the toilet 14. Moreover, the increased height of the seat 36 with respect to the toilet 14 enhances the user's ability to sit on, and subsequently stand from, the seat 36 for urination and defecation. The pan 50 is selectively positioned in the first position to capture the urination and the defection. In this way the chair 12 may be mounted for urination and defecation without being positioned over the toilet 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An auxiliary toilet seat assembly being configured to be positioned around the toilet thereby facilitating an obese person to utilize the toilet, said assembly comprising:

a chair being configured to be positioned over a toilet, said chair being configured to be mounted thereby facilitating urination and defecation into the toilet, said chair having a weight capacity of at least 130.0 kg wherein said chair is configured to support an obese user, said chair having an aperture extending therethrough wherein said aperture is configured to pass urination and defecation therethrough, said chair comprising a pair of uprights, each of said uprights having a pair of first members each extending between a top member and a bottom member, said first members corresponding to each of said uprights being spaced apart from each other such that each of said uprights has a rectangular shape, said bottom member corresponding to each of said uprights being configured to be positioned on a support surface having said top member corresponding to each of said uprights being spaced from the support surface;

a pair of armrests, each of said armrests being coupled to said top member of an associated one of said uprights, each of said armrests including a pair of feet extending between said armrest and said top member of said associated upright such that each of said armrests is spaced from said top member of said associated upright, each pair of feet including a respective forward foot being inwardly offset relative to a front of said armrest, said front of each said armrest being coplanar with a front of said associated upright wherein each said armrest has a free forward end vertically aligned over said front of said associated upright, each of said armrests having a top surface;

a cushion being coupled to said chair wherein said cushion is configured to be sat upon thereby enhancing comfort of said chair; and a pan being slidably coupled to said chair wherein said pan is configured to capture the urination and defecation.

2. The assembly according to claim 1, further comprising a pair of pads, each of said pads being coupled to said top surface of an associated one of said armrests, each of said pads being comprised of a resiliently compressible material wherein each of said pads is configured to enhance comfort of said armrests.

3. The assembly according to claim 1, further comprising a seat having a top surface, a bottom surface, a front side and a back side, said seat being coupled between each of said uprights having said top surface and some bottom surface being horizontally oriented wherein said seat is configured to support the obese user.

4. The assembly according to claim 3, wherein said seat is positioned closer to said top member than said bottom member of said uprights wherein said seat is configured to be spaced above the toilet when said chair is positioned around the toilet.

5. The assembly according to claim 4, wherein said seat has an opening extending through said top surface and said bottom surface wherein said opening is configured to pass urination and defecation therethrough when the user sits on said seat.

6. The assembly according to claim 5, wherein said cushion is positioned on said top surface of said seat, said cushion being continuous such that said cushion forms a closed loop surrounding said opening in said seat.

7. The assembly according to claim 5, further comprising:

said pan having an outer wall, said outer wall having a first lateral side, a second lateral side and a front side; and a pair of tracks, each of said tracks being coupled to said bottom surface of said seat, each of said tracks being positioned on opposite sides of said opening with respect to each other, each of said tracks extending between said front side and said back side of said seat, each of said first lateral side and said second lateral side of said pan slidably engaging an associated one of said tracks.

8. The assembly according to claim 7, wherein said pan is selectively positioned in a first position having said pan being positioned beneath said opening for capturing the urination and defecation, said pan being selectively positioned in a second position having said pan being removed from said seat for emptying said pan.

9. The assembly according to claim 8, further comprising a handle being coupled to said front side of said pan for gripping said pan.

10. An auxiliary toilet seat assembly being configured to be positioned around the toilet thereby facilitating an obese person to utilize the toilet, said assembly comprising:

a chair being configured to be positioned over a toilet, said chair being configured to be mounted thereby facilitating urination and defecation into the toilet, said chair having a weight capacity of at least 130.0 kg wherein said chair is configured to support an obese user, said chair having an aperture extending therethrough wherein said aperture is configured to pass urination and defecation therethrough, said chair comprising;

a pair of uprights, each of said uprights having a pair of first members each extending between a top member and a bottom member, said first members corresponding to each of said uprights being spaced apart from each other such that each of said uprights has a rectangular shape, said bottom member corresponding to each of said uprights being configured to be positioned on a support surface having said top member corresponding to each of said uprights being spaced from the support surface;

a pair of armrests, each of said armrests being coupled to said top member of an associated one of said uprights, each of said armrests including a pair of feet extending between said armrests and said associated top member such that each of said armrests is spaced from said associated top member, each pair of feet including a respective forward foot being inwardly offset relative to a front of said armrest, said front of each said armrest being coplanar with a front of said associated upright wherein each said armrest has a free forward end vertically aligned over said front of said associated upright, each of said armrests having a top surface;

a pair of pads, each of said pads being coupled to said top surface of an associated one of said armrests, each of said pads being comprised of a resiliently compressible material wherein each of said pads is configured to enhance comfort of said armrests; and a seat having a top surface, a bottom surface, a front side and a back side, said seat being coupled between each of said uprights having said top surface and some bottom surface being horizontally oriented wherein said seat is configured to support the obese user, said seat being positioned closer to said top member than said bottom member of said uprights wherein said seat is configured to be spaced above the toilet when said chair is positioned around the toilet, said seat having an opening extending through said top surface and said bottom surface wherein said opening is configured to pass urination and defecation therethrough when the user sits on said seat;

a cushion being coupled to said chair wherein said cushion is configured to be sat upon thereby enhancing comfort of said chair, said cushion being positioned on said top surface of said seat, said cushion being continuous such that said cushion forms a closed loop surrounding said opening in said seat;

a pan being slidably coupled to said chair wherein said pan is configured to capture the urination and defecation, said pan having an outer wall, said outer wall having a first lateral side, a second lateral side and a front side;

a pair of tracks, each of said tracks being coupled to said bottom surface of said seat, each of said tracks being positioned on opposite sides of said opening with respect to each other, each of said tracks extending between said front side and said back side of said seat, each of said first lateral side and said second lateral side of said pan slidably engaging an associated one of said tracks, said pan being selectively positioned in a first position having said pan being positioned beneath said opening for capturing the urination and defecation, said pan being selectively positioned in a second position having said pan being removed from said seat for emptying said pan; and a handle being coupled to said front side of said pan for gripping said pan.

* * * * *